US007540219B1

(12) United States Patent
Shands

(10) Patent No.: US 7,540,219 B1
(45) Date of Patent: Jun. 2, 2009

(54) MULTIPURPOSE GRIPPING BAND FOR REMOVING AN EXISTING LID FROM AN ASSOCIATED JAR AND ASSOCIATED METHOD

(76) Inventor: Russell Shands, 110 Deborah La., Wheeling, IL (US) 60090

( * ) Notice: Subject to any disclaimer, the term of this patent is extended or adjusted under 35 U.S.C. 154(b) by 0 days.

(21) Appl. No.: 12/154,619

(22) Filed: May 23, 2008

Related U.S. Application Data

(60) Provisional application No. 60/931,185, filed on May 23, 2007.

(51) Int. Cl.
*B67B 7/14* (2006.01)

(52) U.S. Cl. ..... 81/3.4; 81/3.39

(58) Field of Classification Search ..... 81/3.4, 81/3.39, 3.43, 3.42, 64; D8/18, 40
See application file for complete search history.

(56) References Cited

U.S. PATENT DOCUMENTS 1,593,947 A * 7/1926 Miller et al. ..... 81/3.42
1,615,196 A * 1/1927 Lilja ..... 81/3.39
1,887,152 A * 11/1932 Geisler ..... 81/3.4
1,913,906 A * 6/1933 Swenson ..... 81/3.4
1,952,660 A * 3/1934 Dryden ..... 81/3.4
2,003,983 A * 6/1935 Thener ..... 81/3.4

* cited by examiner

*Primary Examiner*—Hadi Shakeri

(57) ABSTRACT

A gripping band includes an elastic body that is resiliently adapted to engage an outer surface of an existing lid. The body includes a mechanism for maintaining a non-skid resistive engagement with the lid outer surface for enabling a user to exert sufficient torque along the body to overcome the initial frictional force and thereby remove the lid from the existing jar. The mechanism includes protrusions coupled to the body and juxtaposed about a circumference thereof such that troughs are formed between the protrusions. The protrusions and troughs cooperate to define shoulders against which a user maintains a grip for preventing slippage. An elastic auxiliary body is resiliently adapted to engage an existing jar outer surface, and is positioned at a jar lower portion for providing a gripping surface for assisting the user to stabilize the jar while exerting torque along the body.

8 Claims, 10 Drawing Sheets

MULTIPURPOSE GRIPPING BAND FOR REMOVING AN EXISTING LID FROM AN ASSOCIATED JAR AND ASSOCIATED METHOD

CROSS REFERENCE TO RELATED APPLICATIONS

This application claims the benefit of U.S. Provisional Application No. 60/931,185, filed May 23, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to jar lids and, more particularly, to an integral grasping means for jar lids and the like and associated method for providing users with a convenient and efficient means of opening jar lids.

2. Prior Art

Loosening and removing jar lids is sometimes very difficult. Jars are often vacuum packed and the lids are tightened by mechanical means. This increases the amount of rotational force required to loosen the lids to remove the contents of the jars. Furthermore, at times, the contents of the jars are viscous, so that the contents harden between the surface at the top of the jar and the inner surfaces of the lid. This condition often occurs with heavy, tacky materials such as honey or molasses, as well as other foods which can dry up. People with reduced strength including children, the elderly, women and the ill and infirm sometimes require assistance to loosen and remove the lids on jars. Even strong individuals sometimes require help when lids are held fast by dried materials or when the lids have been strongly tightened by mechanical means at the factory. In addition to loosening the lids on jars to obtain the contents of the jars, it is often desirable to securely tighten the lids. Tightly closing containers with volatile materials is often required to prevent evaporation or the escape of noxious odors. Also, certain materials may be contaminated by oxygen or other outside elements if the jars or containers which are holding the materials are not tightly closed.

Accordingly, a need remains for an integral grasping means for jar lids and the like and associated method in order to overcome the above-noted shortcomings. The present invention satisfies such a need by providing an assembly that is convenient and easy to use, is durable yet lightweight in design, is versatile in its applications, and allows users to easily and efficiently open most any bottled or jarred product. Featuring a nonskid rubber surface, the present invention is effortlessly gripped and turned, providing quick access to a myriad of goods. By eliminating sore, aching hands and fingers which are so often associated with opening sharp, crimped lids and caps, the assembly allows users to open purchased goods in a comfortable fashion. Baby food jars, sauces, soups, canned vegetables and condiments are but a few of the countless items which can easily be accessed via use of the present invention.

BRIEF SUMMARY OF THE INVENTION

In view of the foregoing background, it is therefore an object of the present invention to provide an assembly for providing users with a convenient and efficient means of opening jar lids. These and other objects, features, and advantages of the invention are provided by an integral grasping means for jar lids and the like and associated method.

In a preferred embodiment of the present invention, a multipurpose gripping band for assisting a user to overcome an initial frictional force associated with an existing lid secured to an existing jar preferably includes a body that is formed from elastic material and is resiliently adapted to directly and firmly engage an outer surface of the existing lid. Such a body may have a smooth and continuous inner surface adapted to contiguously abut against the outer surface of the existing lid. The body may also include a mechanism for maintaining a non-skid resistive engagement with the outer surface of the existing lid in such a manner that a user is advantageously able to exert a sufficient torque along the body to overcome the initial frictional force and thereby remove the existing lid from the existing jar.

The non-skid resistive engagement mechanism preferably further includes a plurality of protrusions coupled to the body and equidistantly juxtaposed about an entire circumference thereof such that a plurality of equidistantly spaced troughs are intermediately formed between the protrusions respectively. Such protrusions and troughs may effectively cooperate to define a plurality of shoulders against which a user maintains a grip for conveniently and advantageously preventing undesirable slippage during operating conditions. The protrusions are preferably solid and monolithically formed with the body.

The non-skid resistive engagement mechanism preferably further includes a plurality of chambers formed within respective interiors of the protrusions and the outer surface of the existing lid respectively. Each of the chambers may be hollow and isolated from an adjacent one of the chambers respectively. Each of the chambers preferably includes a plurality of stationary anchor pins seated therein. Each of the anchor pins may have axially opposed ends directly and fixedly coupled to top and bottom walls of each of the protrusions respectively.

A mobile guide pin is preferably intermediately situated between the stationary pin and disposed within the chamber respectively. A plurality of rectilinear arms may be positioned orthogonal to the anchor pins and the guide pin respectively. Each of the arms preferably has a first end pivotally mated to the guide pin. Each of the arms may further have an opposed second end that is pivotally mated to the anchor pins respectively. A cam is preferably mounted to the guide pin and extends along a horizontal plane registered perpendicular to the anchor pins and the guide pin respectively. Each of the cams are preferably selectively and independently adapted to engage the outer surface of the existing lid.

The protrusions are preferably formed from a deformably resilient material for advantageously and effectively maintaining a continuous and direct abutment with a proximal end of the cam in such a manner that the cam is radially urged inwardly and towards the outer surface of the existing lid when an outer wall of the protrusions is pressed inwardly along the horizontal plane to thereby adapt and directly engage a distal end of the cam against the outer surface of the existing lid and further to effectively prevent premature slippage between the body and the existing lid. Such a cam may automatically return to a disengaged position from the exiting lid when the outer wall of the protrusion is released and returned to equilibrium.

An auxiliary body may be formed from elastic material and is resiliently adapted to directly and firmly engage an outer surface of the existing jar. Such an auxiliary body is preferably positioned at a lower portion of the existing jar and advantageously provides a gripping surface for assisting the user to stabilize the existing jar while exerting torque along the body.

In an alternate embodiment of the multipurpose gripping band, the distal end of the cam preferably has a pair of converging sidewalls extending distally away from the outer wall of the protrusion and terminates at an apex.

In another alternate embodiment of the multipurpose gripping band, the distal end of the cam may include a suction cup adapted to maintain a pressurized engagement with the outer surface of the existing lid.

A method for assisting a user to overcome an initial frictional force associated with an existing lid secured to an existing jar includes the steps of: providing a body formed from elastic material; directly and firmly engaging the body with an outer surface of the existing lid by resiliently adapting the body; and maintaining a non-skid resistive engagement between the body and the outer surface of the existing lid by providing a plurality of protrusions coupled to the body that are equidistantly juxtaposed about an entire circumference thereof such that a plurality of equidistantly spaced troughs are intermediately formed between the protrusions respectively. Such protrusions and the troughs cooperate to define a plurality of shoulders against which a user maintains a grip for preventing undesirable slippage during operating conditions.

The method further includes the steps of providing an auxiliary gripping surface for assisting the user to stabilize the existing jar by providing an auxiliary body formed from elastic material; directly and firmly engaging the auxiliary body with an outer surface of the existing jar by resiliently adapting and positioning the auxiliary body at a lower portion of the existing jar; and overcoming the initial frictional force and thereby removing the existing lid from the existing jar by maintaining a firm grip of the auxiliary body while exerting a sufficient torque along the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
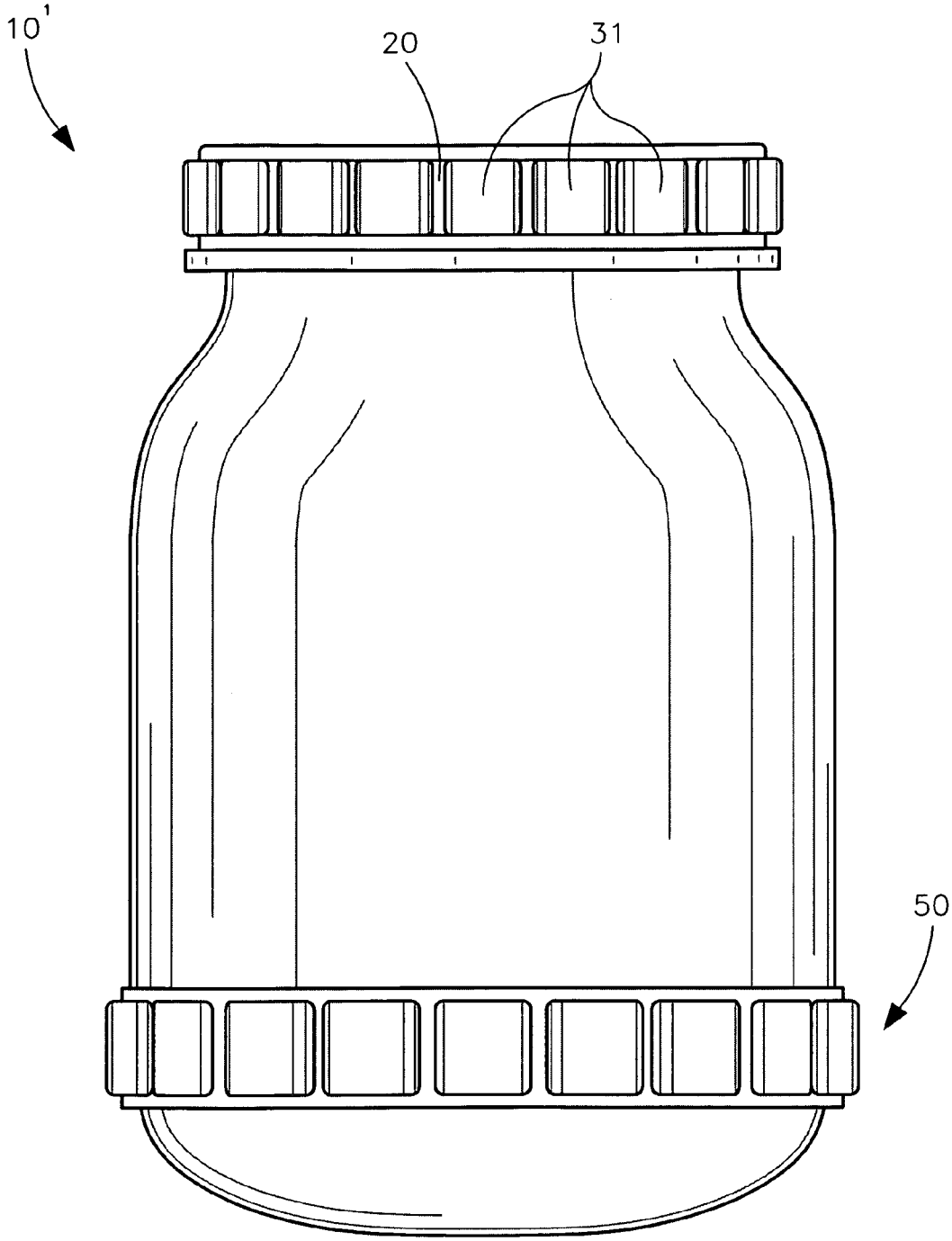
FIG. 1 is a side-elevational view showing an alternate embodiment of the present invention.
Figure 2:
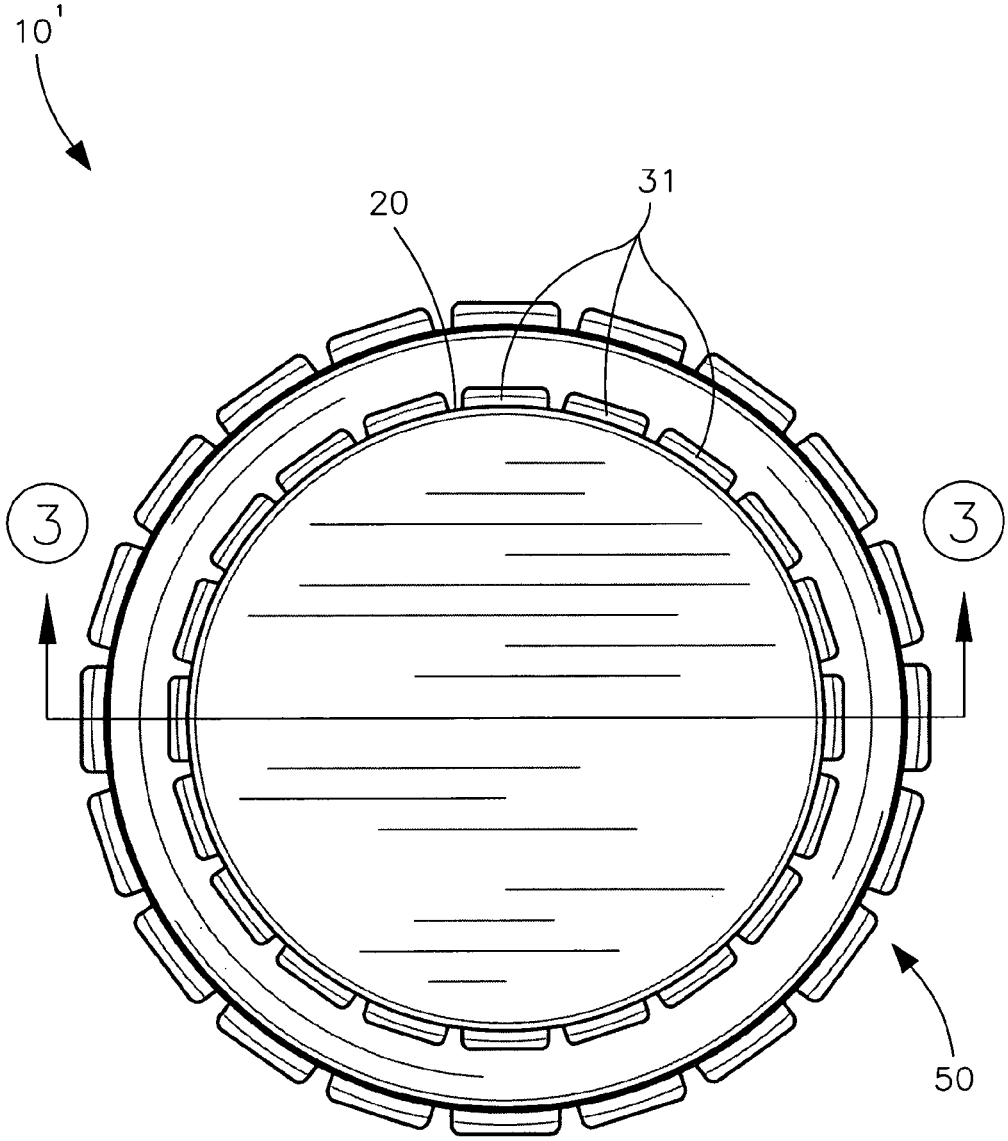
FIG. 2 is a top plan view of the assembly shown in FIG. 1.
Figure 3:
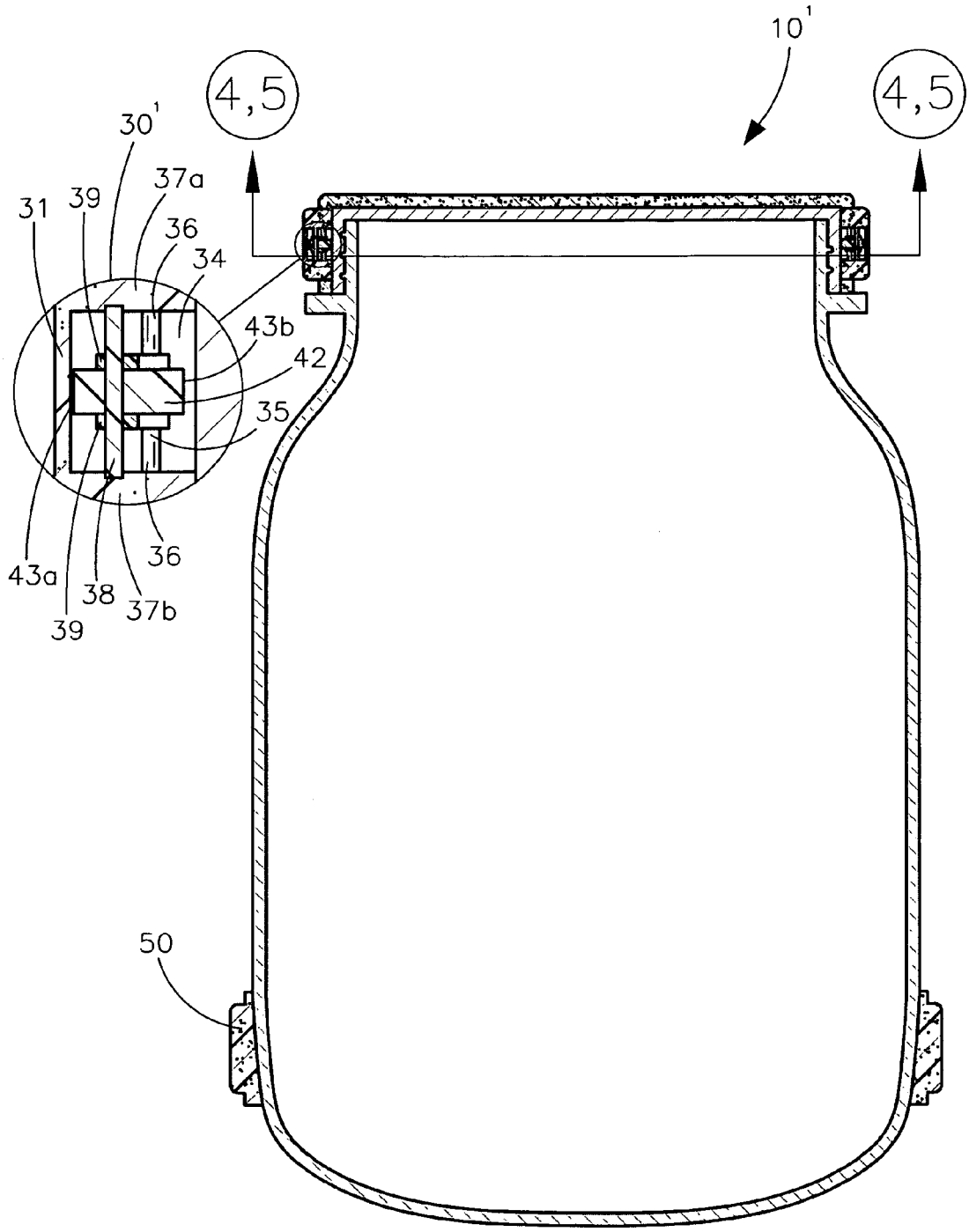
FIG. 3 is a cross-sectional view of the assembly shown in FIG. 2, taken along line 3-3.

The present invention will now be described more fully hereinafter with reference to the accompanying drawings, in which preferred embodiments of the invention are shown. This invention may, however, be embodied in many different forms and should not be construed as limited to the embodiment set forth herein. Rather, these embodiments are provided so that this application will be thorough and complete, and will fully convey the true scope of the invention to those skilled in the art. Like numbers refer to like elements throughout the figures, and prime and double prime numbers refer to alternate embodiment of select elements.

The assembly of this invention is referred to generally in FIGS. 1-8 by the reference numeral 10 and is intended to provide an integral grasping means for jar lids and the like and associated method. It should be understood that the assembly 10 may be used to provide a grasping means in many different types of applications and should not be limited to only being used with existing-jar lids.

Figure 6:
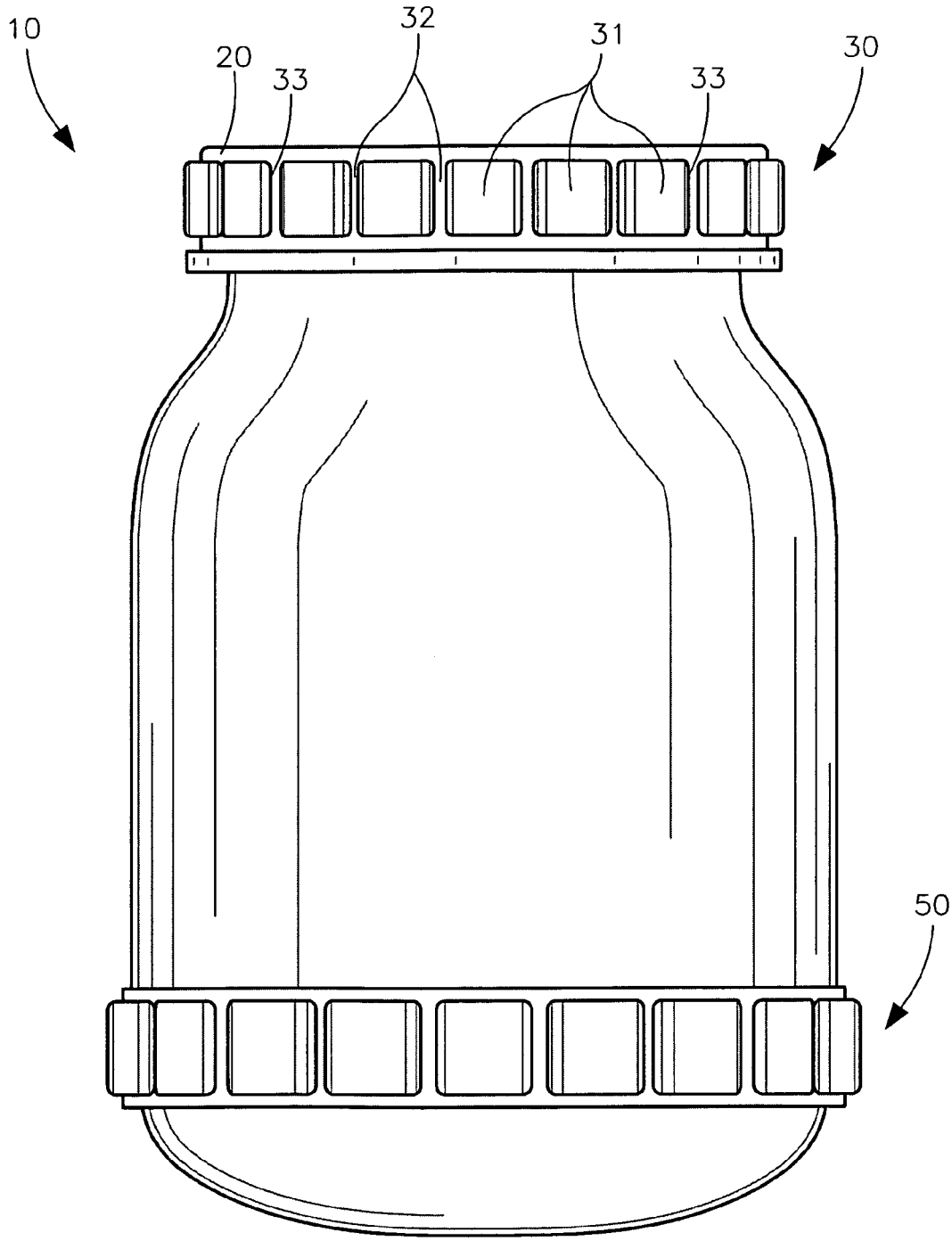
FIG. 6 is side-elevational view showing a preferred embodiment of the present invention.
Figure 7:
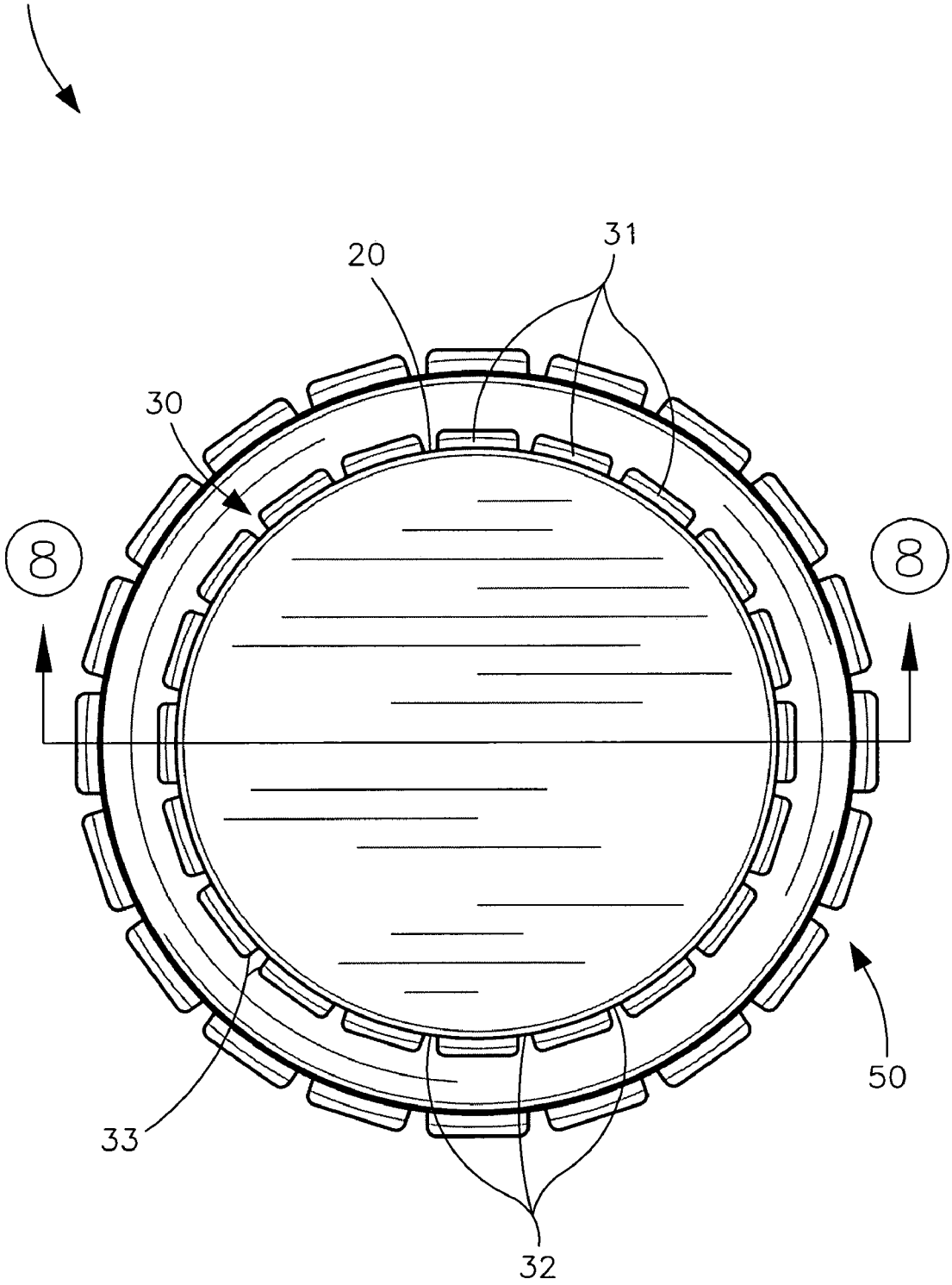
FIG. 7 is a top plan view of the assembly shown in FIG. 6.
Figure 8:
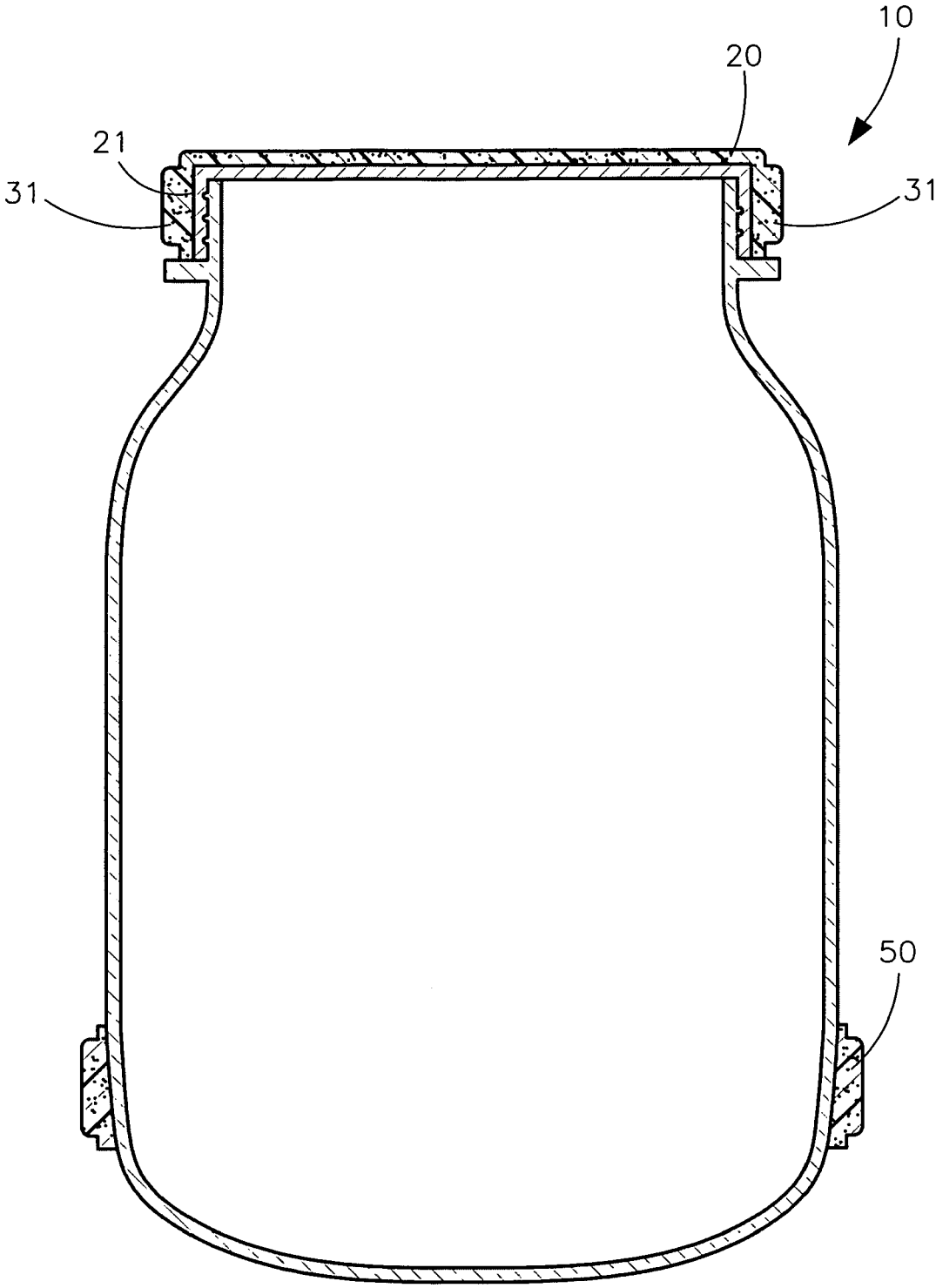
FIG. 8 is a cross-sectional view of the assembly shown in FIG. 7, taken along line 8-8.

Referring initially to FIGS. 6, 7 and 8, in a preferred embodiment of the present invention, a multipurpose gripping band 10 for assisting a user to overcome an initial frictional force associated with an existing lid secured to an existing jar preferably includes a body 20 that is formed from elastic material and is resiliently adapted to directly and firmly engage an outer surface of the existing lid. Of course, the body 20 may be produced in a variety of sizes for being used with alternately sized lids, as is obvious to a person or ordinary skill in the art. Such a body 20 may have a smooth and continuous inner surface 21 adapted to contiguously abut against the outer surface of the existing lid, which is an important feature for ensuring that all the force exerted by the user on the body 20 is imparted to the existing lid. The body 20 may also include a mechanism 30 for maintaining a non-skid resistive engagement with the outer surface of the existing lid in such a manner that a user is advantageously able to exert a sufficient torque along the body 20 to overcome the initial frictional force and thereby remove the existing lid from the existing jar.

Again referring to FIGS. 6, 7 and 8, the non-skid resistive engagement mechanism 30 preferably includes a plurality of protrusions 31 coupled to the body 20 and equidistantly juxtaposed about an entire circumference thereof such that a plurality of equidistantly spaced troughs 32 are intermediately formed between the protrusions 31 respectively. Such protrusions 31 and troughs 32 may effectively cooperate to define a plurality of shoulders 33 against which a user maintains a grip, which is essential for conveniently and advantageously preventing undesirable slippage during operating conditions. The protrusions 31 are preferably solid and monolithically formed with the body 20.

Now referring to FIGS. 1-4*b*, an alternate embodiment is shown wherein the non-skid resistive, engagement mechanism 30' preferably includes a plurality of chambers 34 formed within respective interiors of the protrusions 31 and the outer surface of the existing lid respectively. Each of the chambers 34 may be hollow and isolated from an adjacent one of the chambers 34 respectively. Each of the chambers 34 preferably includes a plurality of stationary anchor pins 35 seated therein. Each of the anchor pins 35 may have axially opposed ends 36 directly and fixedly coupled, without the use of intervening elements, to top 37A and bottom 37B walls of each of the protrusions 31 respectively.

Again referring to FIGS. 1-4*b*, a mobile guide pin 38 is preferably intermediately situated between the stationary anchor pins 35 and disposed within the chamber 34 respectively. A plurality of rectilinear arms 39 may be positioned orthogonal to the anchor pins 35 and the guide pin 38 respectively. Each of the arms 39 preferably has a first end 41A pivotally mated to the guide pin 38. Each of the arms 39 may further have an opposed second end 41B that is pivotally mated to the anchor pins 35 respectively. A cam 42 is preferably mounted to the guide pin 38 and extends along a horizontal plane registered perpendicular to the anchor pins 35 and the guide pin 38 respectively.

Each of the cams 42 is preferably selectively and independently adapted to engage the outer surface of the existing lid. The combination of the pivoting rectilinear arms 39 and cams 42 provides an unpredictable and unexpected result which is not rendered obvious by one skilled in the art, wherein a person's grasp of an existing lid is improved by creating a higher coefficient of friction between the cam 42 and the lid than what is possible to achieve between the person's bare hand and the lid. The present invention is also effective in removing safety plastic seals positioned about lids as often found in pharmaceutical containers, for example.

Referring to FIGS. 1-5*b*, the protrusions 31 are preferably formed from a deformably resilient material, which is vital for advantageously and effectively maintaining a continuous and direct abutment with a proximal end 43A of the cam 42 in such a manner that the cam 42 is radially urged inwardly and towards the outer surface of the existing lid when an outer wall 44 of the protrusions 31 is pressed inwardly along the horizontal plane to thereby adapt and directly engage a distal end 43B of the cam 42 against the outer surface of the existing lid and further to effectively prevent premature slippage between the body 20 and the existing lid. Such a cam 42 may automatically return to a disengaged position from the existing lid when the outer wall 44 of the protrusion 31 is released and returned to equilibrium.

Referring to FIGS. 1-8, an auxiliary body 50 may be formed from elastic material and is resiliently adapted to directly and firmly engage, without the use of intervening elements, an outer surface of the existing jar. Such an auxiliary body 50 is preferably positioned at a lower portion of the existing jar, which is crucial and advantageous for providing a gripping surface for assisting the user to stabilize the existing jar while exerting torque along the body 20.

Figure 4A:
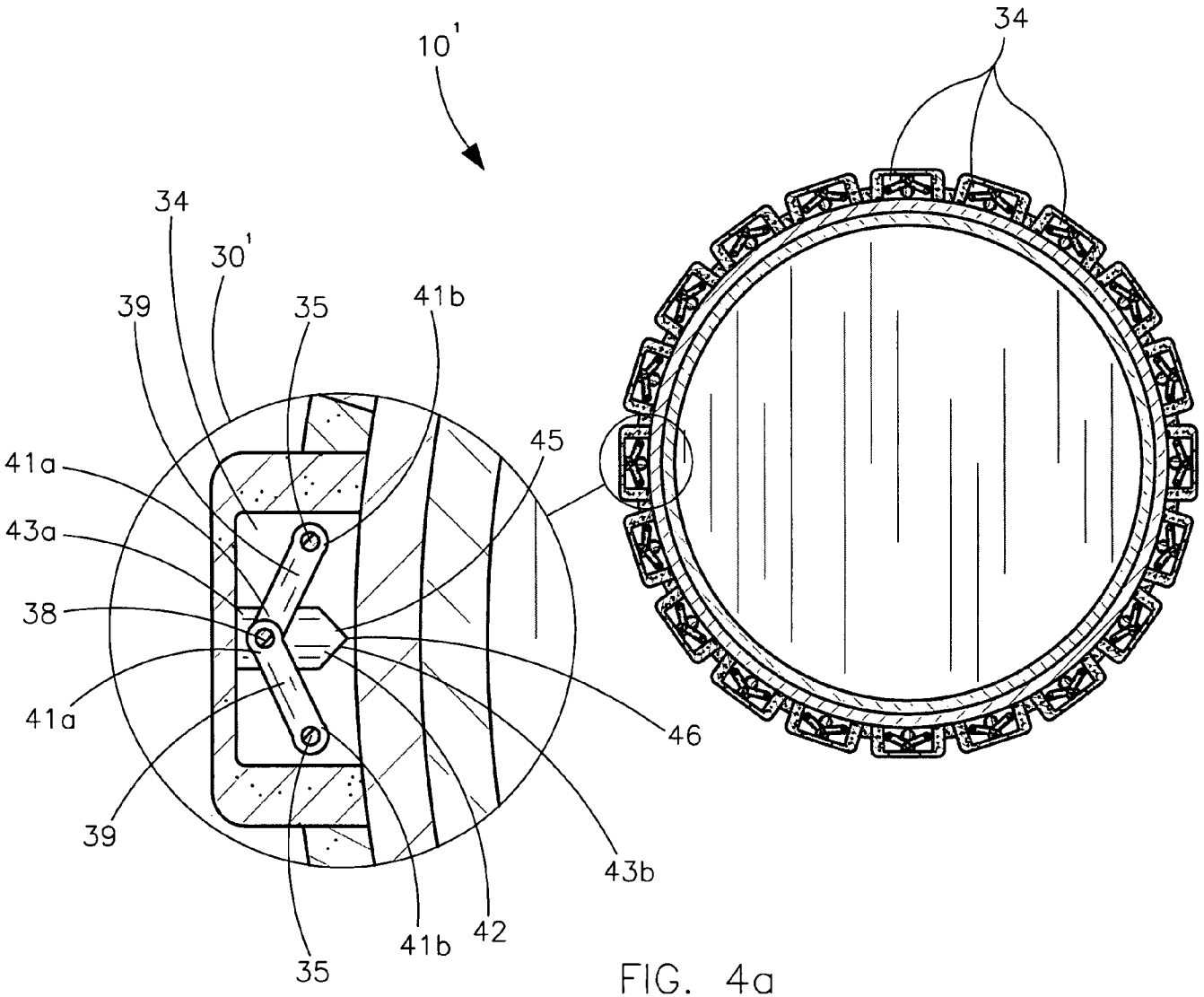
FIG. 4*a* is a is a cross-sectional view of the assembly shown in FIG. 3, taken along line 4-4.
Figure 4B:
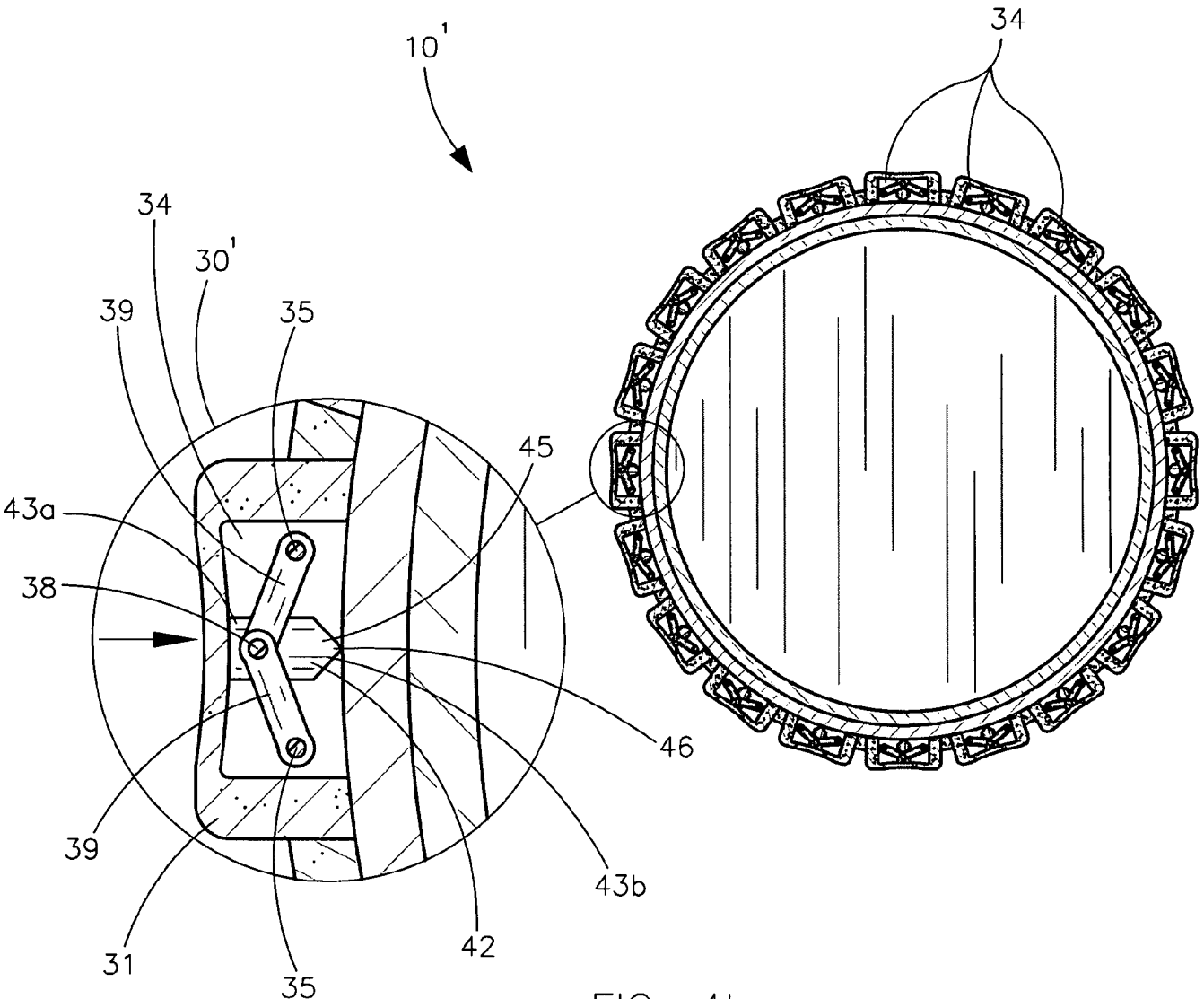
FIG. 4*b* is a cross-sectional view of the assembly shown in FIG. 3, taken along line 4-4, showing the cams engaged with the outer surface of the existing lid.

Referring to FIGS. 4*a* and 4*b*, the distal end 43B of the cam 42 preferably has a pair of converging sidewalls 45 extending distally away from the outer wall 44 of the protrusion 31 and terminates at an apex 46. Such an apex 46 provides the unexpected and unpredictable benefit of securely engaging the outer surface of an existing lid when a user grasps the protrusions 31 of the body 20, so that any rotational force exerted on the body 20 by the user is effectively translated to the lid via the apex 46 of the cam 42.

Figure 5A:
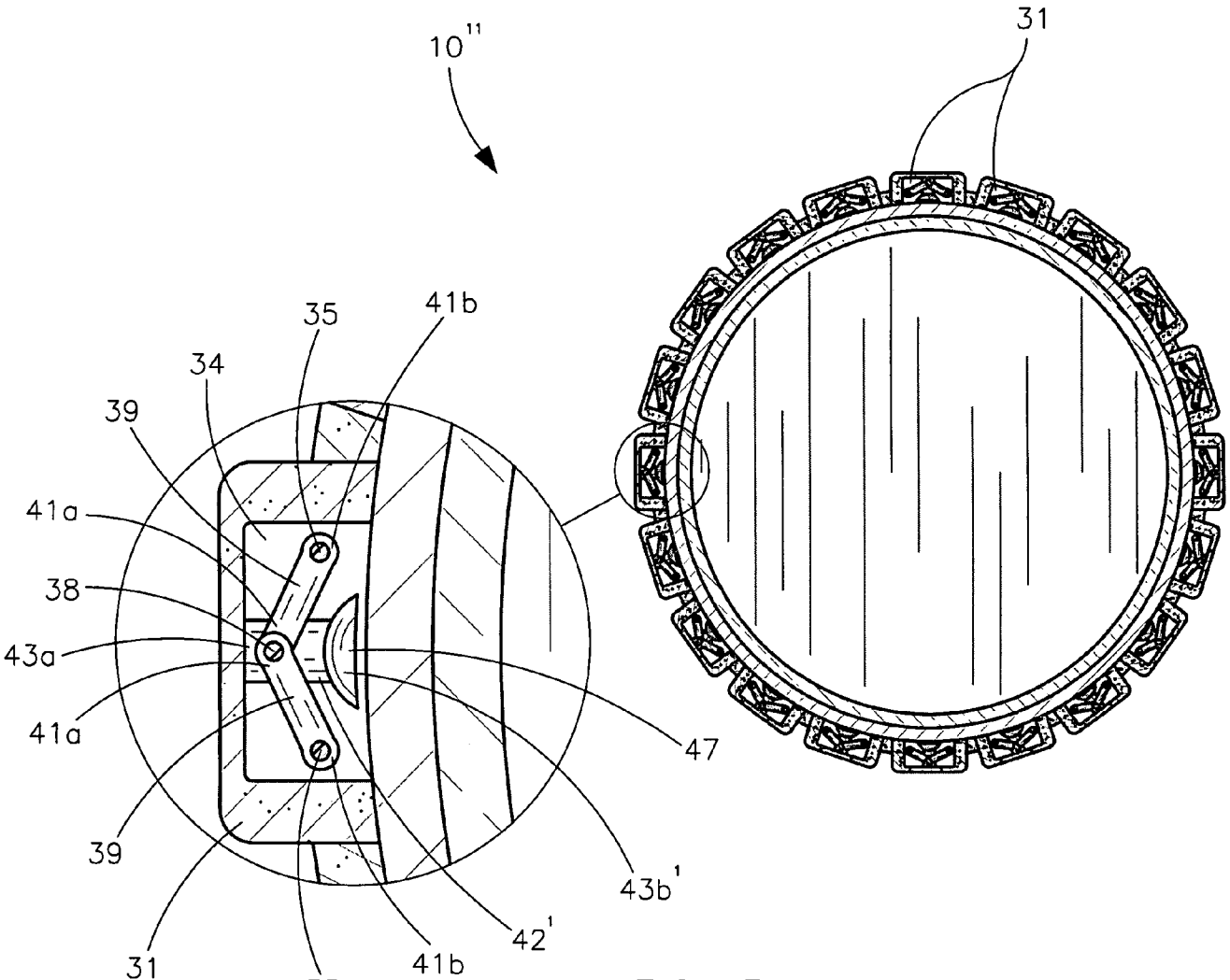
FIG. 5*a* is a cross-sectional view of the assembly shown in FIG. 3, taken along 5-5, showing another embodiment of the present invention.
Figure 5B:
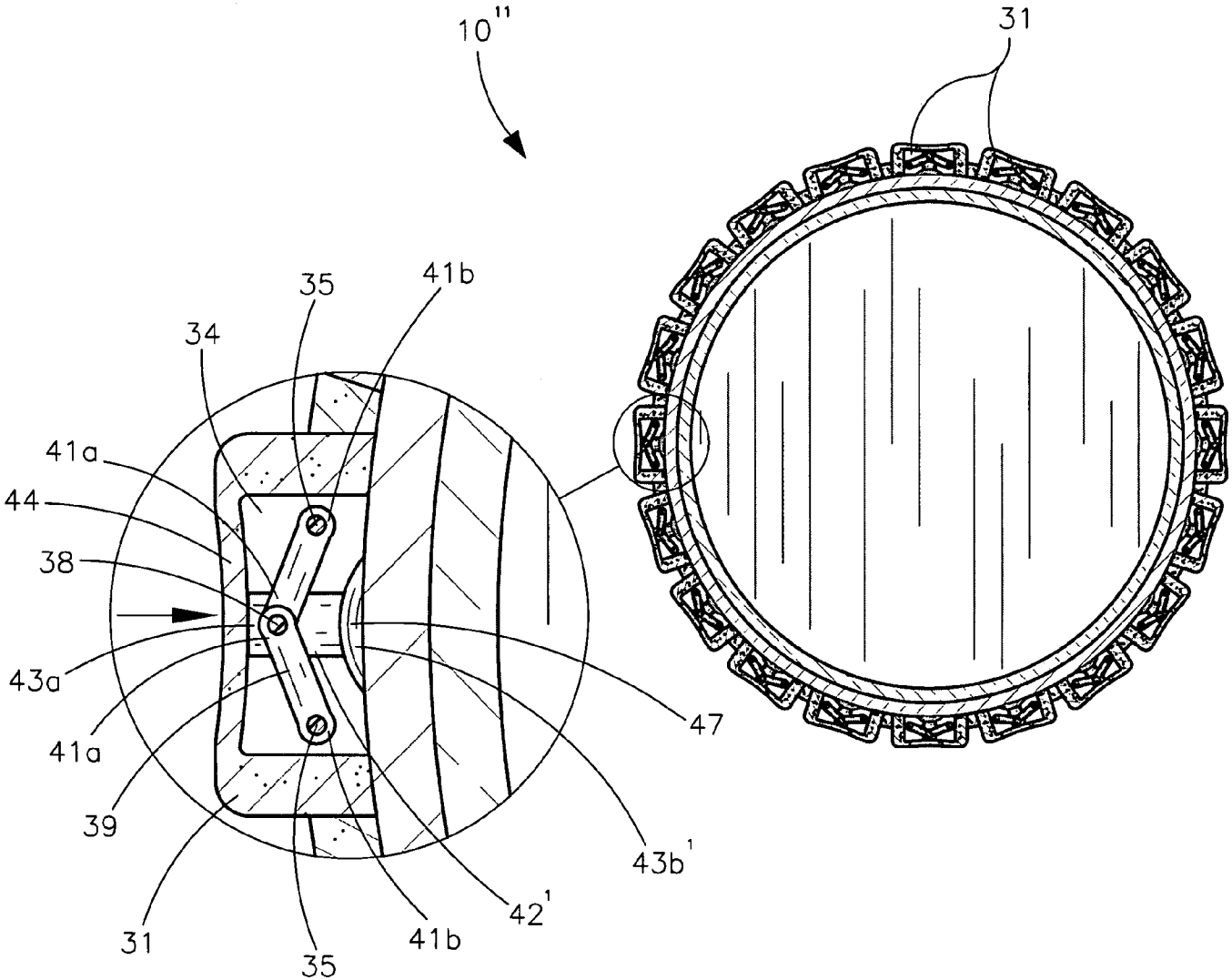
FIG. 5*b* is a cross-sectional view of the assembly shown in FIG. 3, taken along line 5-5, showing the cams engaged with the outer surface of the existing lid.

Referring to FIGS. 5*a* and 5*b*, in an alternate embodiment of the multipurpose gripping band 10", the distal end 43B' of the cam 42' may include a suction cup 47 adapted to maintain a pressurized engagement with the outer surface of the existing lid. Such suction cups 47 provide the unexpected and unpredictable benefit of securely grasping moist surfaces, for example lids with condensation thereon due to being stored in a refrigerator, which advantageously greatly increases the amount of force imparted to the lid by the user's hand through the body 20.

The assembly 10 can effectively engage an existing lid of glass bottles and jars, and is easily gripped by a user. The assembly 10 includes a durable rubber body 20 that is directly secured, without the use of intervening elements, around the outer surface of the existing lid. Such a body 20 is vital for providing a nonskid surface for the user to grip in order to turn and efficiently open the lidded item. Of course, the lid and jar could be produced in a variety of sizes appropriate for use on virtually any product, including but not limited to pickles, sauces, soups and gravy, as is obvious to a person of ordinary skill in the art.

The lid may be produced from stamped metal. Of course, the lid may be produced from other materials, like heavy duty plastic, as is obvious to a person of ordinary skill in the art. The flexible rubber body 20 that is securely positioned around the lid measures ⅛" in depth, and stretches around the exterior of the lid, snugly adhering to the outer surface thereof. Such a body 20 has a slightly sticky and textured surface that is important for allowing a user to firmly grasp the lid while opening or closing the container. Of course, the lid and jar could be produced in a variety of fun and funky colors, as well as be emblazoned with various logos and product names, as is obvious to a person of ordinary skill in the art.

In use, a method for assisting a user to overcome an initial frictional force associated with an existing lid secured to an existing jar includes the steps of: providing a body 20 formed from elastic material; directly and firmly engaging the body 20 with an outer surface of the existing lid by resiliently adapting the body 20; and maintaining a non-skid resistive engagement between the body 20 and the outer surface of the existing lid by providing a plurality of protrusions 31 coupled to the body 20 that are equidistantly juxtaposed about an entire circumference thereof such that a plurality of equidistantly spaced troughs 32 are intermediately formed between the protrusions 31 respectively. Further steps included the protrusions 31 and the troughs 32 cooperating to define a plurality of shoulders 33 against which a user maintains a grip for preventing undesirable slippage during operating conditions.

The method further includes the steps of providing an auxiliary gripping surface for assisting the user to stabilize the existing jar by providing an auxiliary body 50 formed from elastic material; directly and firmly engaging the auxiliary body 50 with an outer surface of the existing jar by resiliently adapting and positioning the auxiliary body 50 at a lower portion of the existing jar; and overcoming the initial frictional force and thereby removing the existing lid from the existing jar by maintaining a firm grip of the auxiliary body 50 while exerting a sufficient torque along the body 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multipurpose gripping band for assisting a user to overcome an initial frictional force associated with an existing lid secured to an existing jar, said multipurpose gripping band comprising:

a body formed from elastic material and being resiliently adapted to directly and firmly engage an outer surface of the existing lid, wherein said body comprises means for maintaining a non-skid resistive engagement with the outer surface of the existing lid in such a manner that a user is able to exert a sufficient torque along said body to overcome the initial frictional force and thereby remove the existing lid from the existing jar;

wherein said non-skid resistive engagement means comprises a plurality of protrusions coupled to said body and equidistantly juxtaposed about an entire circumference thereof such that a plurality of equidistantly spaced troughs are intermediately formed between said protrusions respectively;

wherein said protrusions and said troughs cooperate to defined a plurality of shoulders against which a user maintains a grip for preventing undesirable slippage during operating conditions;

wherein said non-skid resistive engagement means further comprises:

a plurality of chambers formed within respective interiors of said protrusions and the outer surface of the existing lid respectively, each of said chambers being hollow and isolated from an adjacent one of said chambers respectively;

wherein each of said chambers comprises a plurality of stationary anchor pins seated therein, each of said anchor pins having axially opposed ends directly and fixedly coupled to top and bottom walls of each of said protrusions respectively, a mobile guide pin intermediately situated between said stationary pin and disposed within said chamber respectively, a plurality of rectilinear arms positioned orthogonal to said anchor pins and said guide pin respectively, each of said arms having a first end pivotally mated to said guide pin, each of said arms further having a opposed second end pivotally mated to said anchor pins respectively, and a cam mounted to said guide pin and extending along a horizontal plane registered perpendicular to said anchor pins and said guide pin respectively;

wherein said protrusions are formed from deformably resilient material for maintaining a continuous and direct abutment with a proximal end of said cam in such a manner that said cam is radially urged inwardly and towards the outer surface of the existing lid when an outer wall of said protrusions is pressed inwardly along the horizontal plane to thereby adapt and directly engage a distal end of said cam against the outer surface of the existing lid and further to prevent premature slippage between said body and the existing lid;

wherein said cam automatically returns to a disengaged position from the exiting lid when said outer wall of said protrusion is released and returned to equilibrium.

2. The multipurpose gripping band of claim 1, wherein said distal end of said cam has a pair of converging sidewalls extending distally away from said outer wall of said protrusion and terminating at an apex.

3. The multipurpose gripping band of claim 1, wherein said distal end of said cam comprises a suction cup adapted to maintain a pressurized engagement with the outer surface of the existing lid.

4. The multipurpose gripping band of claim 1, wherein each of said cams are selectively and independently adapted to engage the outer surface of the existing lid.

5. A multipurpose gripping band for assisting a user to overcome an initial frictional force associated with an existing lid secured to an existing jar, said multipurpose gripping band comprising:

a body formed from elastic material and being resiliently adapted to directly and firmly engage an outer surface of the existing lid, wherein said body comprises means for maintaining a non-skid resistive engagement with the outer surface of the existing lid in such a manner that a user is able to exert a sufficient torque along said body to overcome the initial frictional force and thereby remove the existing lid from the existing jar;

wherein said non-skid resistive engagement means comprises a plurality of protrusions coupled to said body and equidistantly juxtaposed about an entire circumference thereof such that a plurality of equidistantly spaced troughs are intermediately formed between said protrusions respectively;

wherein said protrusions and said troughs cooperate to defined a plurality of shoulders against which a user maintains a grip for preventing undesirable slippage during operating conditions; and an auxiliary body formed from elastic material and being resiliently adapted to directly and firmly engage an outer surface of the existing jar, said auxiliary body being positioned at a lower portion of the existing jar and providing a gripping surface for assisting the user to stabilize the existing jar while exerting torque along said body;

wherein said non-skid resistive engagement means further comprises:

a plurality of chambers formed within respective interiors of said protrusions and the outer surface of the existing lid respectively, each of said chambers being hollow and isolated from an adjacent one of said chambers respectively;

wherein each of said chambers comprises a plurality of stationary anchor pins seated therein, each of said anchor pins having axially opposed ends directly and fixedly coupled to top and bottom walls of each of said protrusions respectively, a mobile guide pin intermediately situated between said stationary pin and disposed within said chamber respectively, a plurality of rectilinear arms positioned orthogonal to said anchor pins and said guide pin respectively, each of said arms having a first end pivotally mated to said guide pin, each of said arms further having a opposed second end pivotally mated to said anchor pins respectively, and a cam mounted to said guide pin and extending along a horizontal plane registered perpendicular to said anchor pins and said guide pin respectively;

wherein said protrusions are formed from deformably resilient material for maintaining a continuous and direct abutment with a proximal end of said cam in such a manner that said cam is radially urged inwardly and towards the outer surface of the existing lid when an outer wall of said protrusions is pressed inwardly along the horizontal plane to thereby adapt and directly engage a distal end of said cam against the outer surface of the existing lid and further to prevent premature slippage between said body and the existing lid;

wherein said cam automatically returns to a disengaged position from the exiting lid when said outer wall of said protrusion is released and returned to equilibrium.

6. The multipurpose gripping band of claim 5, wherein said distal end of said cam has a pair of converging sidewalls extending distally away from said outer wall of said protrusion and terminating at an apex.

7. The multipurpose gripping band of claim 5, wherein said distal end of said cam comprises a suction cup adapted to maintain a pressurized engagement with the outer surface of the existing lid.

8. The multipurpose gripping band of claim 5, wherein each of said cams are selectively and independently adapted to engage the outer surface of the existing lid.

* * * * *